United States Patent [19]

Miller, Jr.

[11] Patent Number: 4,656,953

[45] Date of Patent: Apr. 14, 1987

[54] EXPANDING TABLE TOP FOR DISPLAY OF DECORATIVE TILES

[76] Inventor: Walton H. Miller, Jr., 1008 E. Ash St., Goldsboro, N.C. 27530

[21] Appl. No.: 812,464

[22] Filed: Dec. 23, 1985

[51] Int. Cl.[4] ..... A47B 57/00

[52] U.S. Cl. ..... 108/153; 108/64

[58] Field of Search ..... 108/153, 54.1, 154, 108/65, 83, 90, 64, 157, 159; 248/670, 15

[56] References Cited

U.S. PATENT DOCUMENTS

| | | | |
|---|---|---|---|
| 361,271 | 4/1887 | Durgin | 108/83 |
| 687,712 | 12/1901 | D'Apery | 108/83 |
| 1,151,291 | 8/1915 | Sampson | 108/153 X |
| 1,203,752 | 11/1916 | Le Claire | 108/90 |
| 1,547,685 | 7/1925 | Rhodes | 108/83 X |
| 2,550,620 | 4/1951 | Svedberg | 108/153 X |
| 2,739,776 | 3/1956 | Terando | 108/54.1 |
| 3,688,707 | 9/1972 | White | 108/90 X |
| 4,020,771 | 5/1977 | Hasenour | 108/65 X |
| 4,192,083 | 3/1980 | Rebbeck | 108/64 X |
| 4,297,952 | 11/1981 | Zagaroli | 108/65 X |
| 4,467,730 | 8/1984 | Borichevsky | 108/151 X |

FOREIGN PATENT DOCUMENTS

| | | | |
|---|---|---|---|
| 2444287 | 3/1976 | Fed. Rep. of Germany | 108/65 |
| 2520212 | 7/1983 | France | 108/64 |
| 5354 | of 1903 | United Kingdom | 108/65 |
| 30248 | 12/1930 | United Kingdom | 108/65 |

*Primary Examiner*—Kenneth J. Dorner
*Assistant Examiner*—José V. Chen
*Attorney, Agent, or Firm*—Harvey B. Jacobson; Clarence A. O'Brien

[57] ABSTRACT

A table construction is provided including an upper peripheral frame and the support legs dependingly supported from peripherally spaced portions of the frame. At least three table top sections are supported from the frame and mounted thereover for guided movement relative thereto along an equal number of generally straight paths extending generally radially of a vertical axis extending centrally through the frame. The table top sections are displaceable along the paths between inner and outer positions and include predetermined outwardly facing marginal portions equipped with upwardly projecting curbs together effectively defining a continuous marginal curb about the top of the table construction within whose boundary a plurality of coplanar panel shaped articles supported from the table top sections may be embracingly engaged.

10 Claims, 5 Drawing Figures

EXPANDING TABLE TOP FOR DISPLAY OF DECORATIVE TILES

BACKGROUND OF THE INVENTION

1. Field of the Invention

This invention relates to a table top construction including peripherally spaced table top sections shiftable outwardly from and inwardly toward a central area of the table top formed by the table top sections and the sections include marginal portions together defining the outer periphery of the table top when the sections are in their inner positions and the marginal portions include upstanding curb portions between which a plurality of decorative panel shaped articles such as decorative tiles may be embracingly engaged for stationary support from the table top.

2. Description of Related Art

Various different forms of tables equipped with demountable tops as well as expandable tops heretofore have been provided. Examples of these types of constructions are disclosed in U.S. Pat. Nos. 1,770,755, 2,163,093, 2,310,974, 2,903,312, 3,004,814, 3,688,707, 4,020,771 and 4,297,952. However, these previously known structures do not include the operational features of the instant invention nor are they designed to perform the intended function of the instant invention.

SUMMARY OF THE INVENTION

The table construction of the instant invention includes a table incorporating an upper peripheral frame and depending support legs. At least three table top sections are supported from the frame in superposed relation thereto and mounted from the frame for guided movement along generally straight paths, equal to the number of table top sections, extending generally radially of a vertical axis extending centrally through the table. The table top sections are displaceable along the aforementioned paths between inner and outer positions and include predetermined outer marginal portions equipped with upwardly projecting curbs which together define an effectively continuous marginal curb about the table top, when the top sections are in their inner positions, and within whose boundary a plurality of generally co-planar panel-like articles supported from the table top sections may be embracingly engaged.

The main object of this invention is to provide a table construction from whose top decorative panel members, such as tiles, may be removably displayed.

Another object of this invention is to provide a table top in accordance with the preceding objects and constructed in a manner whereby the panel members or tiles supported therefrom are embracingly engaged by shiftable portions of the table top disposed about the outer periphery thereof in a releasable manner to thereby enable the panel members to be readily removed and/or changed when desired.

Still another important object of this invention is to provide a table top in accordance with the preceding objects and which may be of various shapes in plan.

A final object of this invention to be specifically enumerated herein is to provide a table top in accordance with the preceding objects and which will conform to convention forms of manufacture, be of simple construction and easy to use so as to provide a device that will be economically feasible, longlasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
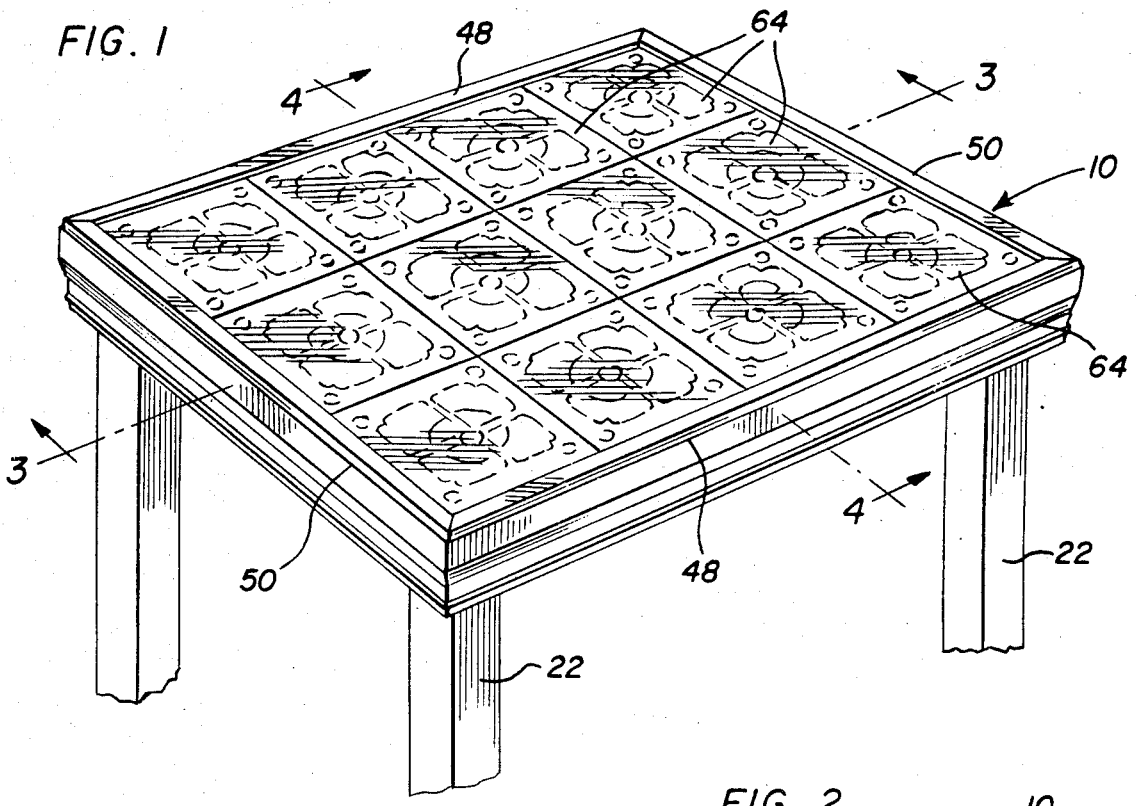
FIG. 1 is a perspective view of a table constructed in accordance with the present invention with the lower ends of the legs of the table broken away.

Referring now more specifically to the drawings the numeral 10 generally designates the table construction of the instant invention. The table construction 10 includes an upper frame referred to in general by the reference numeral 12. The frame 12 includes opposite side and end frame members 16 and 18 joined at their adjacent ends to define a generally rectangular frame. In addition, a frame top panel 20 overlies and is supported from the frame members 16 and 18. Further, the table includes four depending legs 22 suitably anchored in the four corner portions of the upper frame 12 immediately beneath the frame top panel 20 and the frame top panel 20 includes central transverse and longitudinal dovetail grooves 24 and 26 formed therein.

Pairs of opposite side and opposite end top sections 28 and 30 are supported from the frame top panel 20 and include dovetail followers 32 and 34 slidingly received in the grooves 24 and 26. Also, the frame top panel 20 includes opposite side and opposite end central transverse and longitudinal slots 36 and 38 formed therein downwardly through which threaded studs 40 and 42 extend. The studs 40 and 42 are supported from the top sections 28 and 30 and are slidingly received in the slots 36 and 38, friction washers 44 and threaded wingnuts 46 being disposed on the lower ends of the studs 40 and 42.

Figure 2:
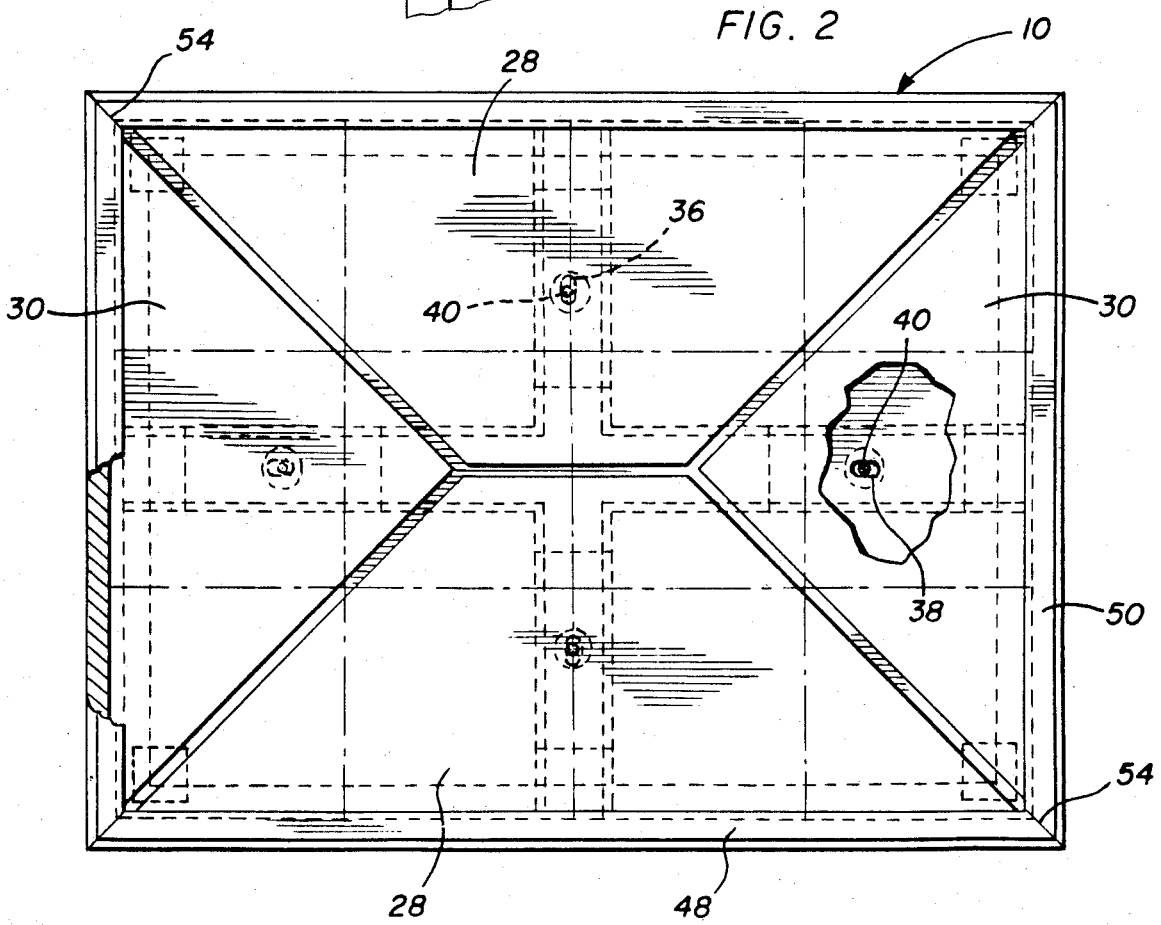
FIG. 2 is an enlarged top plan view of the table with the decorative tiles removed and one outer marginal portion of one of the shiftable table top sections of the table broken away and illustrated in horizontal section.
Figure 3:
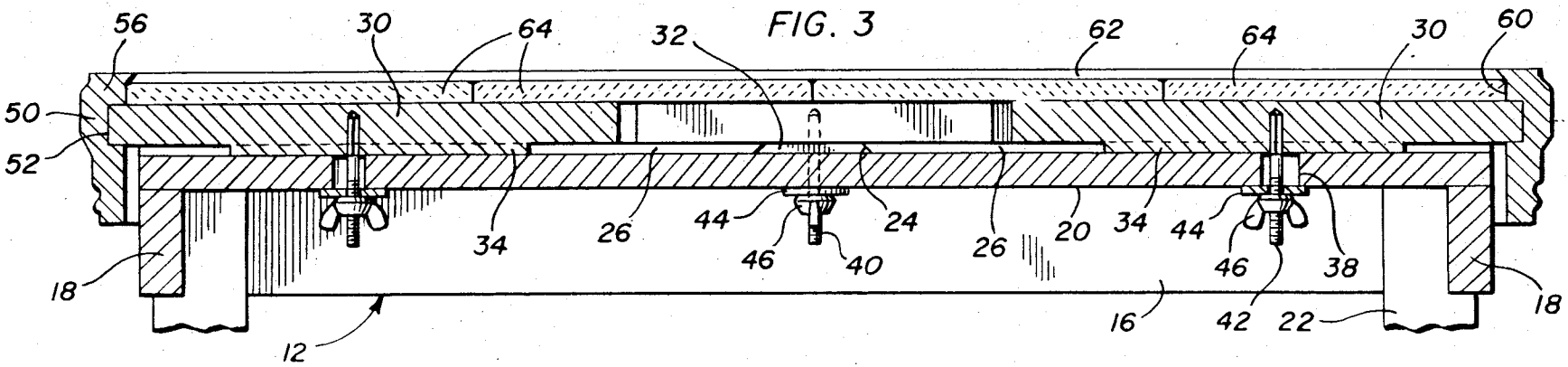
FIG. 3 is an enlarged vertical sectional view taken substantially upon the plane indicated by the section line 3—3 of FIG. 1.

From FIG. 2 of the drawings it may be seen that the top sections 30 are generally triangular in plan shape and that the top sections 28 are generally trapazoidal in shape. Further, from FIGS. 2, 3 and 4 of the drawings it may be seen that the base edges of the sections 28 and 30 include lengthwise extending trim strips 48 and 50 which are grooved as at 52 to seatingly receive the opposing base edges of the sections 28 and 30. The trim strips 48 and 50 are mitered at 45 degrees on their opposite ends as at 54, see FIG. 2, and include upwardly projecting curb defining upper marginal portions 58 and 56 which together define a substantially continuous curb extending about the outer periphery of the top sections 28 and 30 when the latter are in their innermost positions illustrated in FIG. 2 of the drawings. In addition, the upper marginal portions 56 and 58 are undercut as at 60 and 62 to captively receive the outer peripheral edge portions of a plurality of assembled edge-to-edge abutted generally planar decorative tiles 64 therebetween, see FIGS. 1, 3 and 4.

Figure 4:
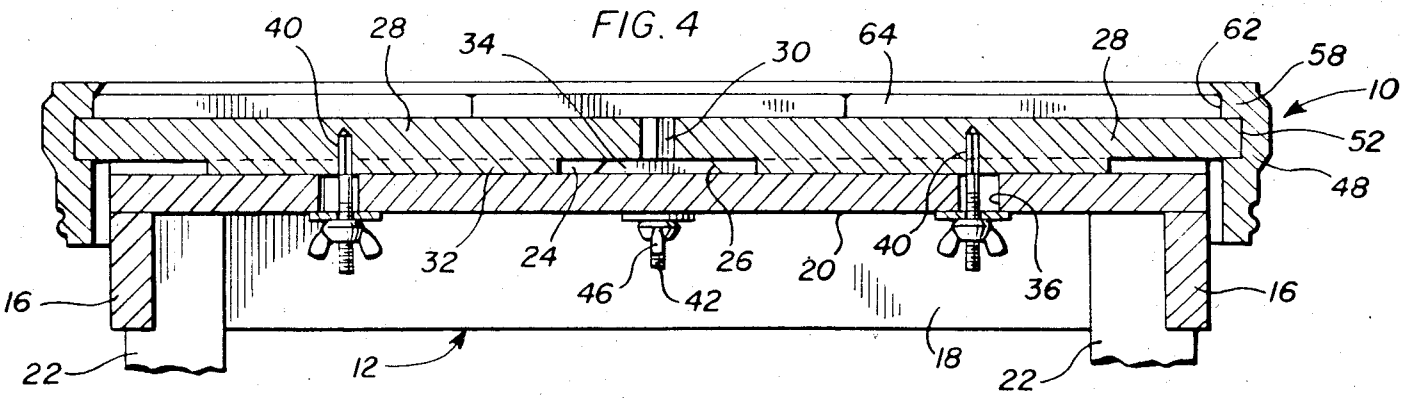
FIG. 4 is an enlarged vertical sectional view taken substantially upon the plane indicated by the section line 4—4 of FIG. 1.
Figure 5:
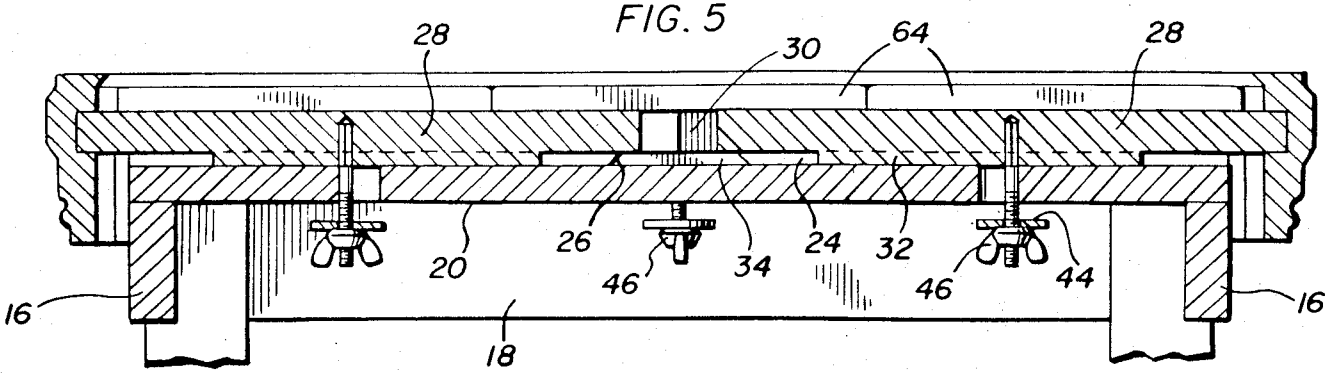
FIG. 5 is a vertical sectional view similar to FIG. 4 but with the shiftable table top sections of the table in outward extended positions to enable removal of the decorative tiles from the table top.

When the wingnuts 46 are tightened in the manner illustrated in FIG. 4 of the drawings the top sections 28 and 30 and the respective trim strips 48 are secured in their innermost positions whereby the outer periphery of the assemblage of decorative tiles 64 supported from the top sections 28 and 30 is retained captive in the undercut portions 60 and 62 of the trim strips 48 and 50. However, when the wing nuts 46 are loosened and the top sections 28 and 30 are shifted slightly outwardly to the positions thereof illustrated in FIG. 5, the decorative tiles 62 suported from the top sections 28 and 30 may be readily removed for cleaning, maintenance or to be replaced by other decorative tiles. Of course, when either the repaired, cleaned or new tiles are placed upon the top sections 28 and 30, the top sections 28 and 30 are again slid inwardly to their innermost positions embracingly engaging the replaced tiles and thereafter the wing nuts 46 may again be tightened.

It is pointed out that the plan shape of the table may be rectangular (as shown), square, triangular, circular or of regular polygonal shape having more than four equal sides.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A table construction for the replaceable display of panel-shaped articles in generally coplanar relation, said table construction including an upper generally horizontal peripheral frame and support legs dependingly supported from peripherally spaced portions of said frame, at least three generally horizontal table top sections, said table top sections and frame including coacting guide means supporting said sections from said frame in position overlying said frame and for independent guided horizontal movement of said sections relative to said frame between predetermined inner and outer limit positions along generally straight paths equal in number to the number of said sections and extending generally radially of a vertical axis extending centrally through said frame, said table top sections including outwardly facing generally straight outer elongated marginal portions extending therealong and equipped with upwardly projecting curb portions which together define an effectively continuous marginal curb about said table top sections when the latter are in their inner limit positions, a plurality of horizontal coplanar panel-shaped articles removably gravity supported upon said table top sections for omnidirectional horizontal shifting thereof relative to said table top sections, said articles being entirely confined within the boundary of said curb and snugly embracingly engaged thereby against said horizontal shifting when said sections are in said inner positions.

2. The table construction of claim 1 wherein said table tops sections together define a table top of four-sided polygonal shape.

3. The table construction of claim 2 wherein said shape comprises a rectangle, one pair of said table top sections being disposed at opposite ends of said table construction and a second pair of table top sections being disposed at opposite sides of said table construction.

4. The table construction of claim 3 wherein said one pair of table top sections are generally triangular in plan shape and said second pair of table top sections are trapezoidal in plan shape.

5. The table construction of claim 2 wherein said shape comprises a rectangle, one pair of said table top sections being disposed at opposite ends of said table construction and a second pair of table top sections being disposed at opposite sides of said table construction, said frame including crossed upwardly opening longitudinal and transverse dovetail grooves formed therein, said table top end and side sections including a dovetail follower slidingly engaged in the opposite ends of said longitudinal and transverse grooves, respectively.

6. The table top construction of claim 1 wherein adjacent ends of said outwardly facing marginal portions are mitered and seatingly engaged with each other when said table top sections are in their inner positions.

7. The table construction of claim 1 wherein said co-acting means includes means operable to releaseably retain said table top sections in their inner positions.

8. The table construction of claim 7 wherein said table tops sections together define a table top of four-sides polygonal shape.

9. The table construction of claim 8 wherein said shape comprises a rectangle, one pair of said table top sections being disposed at opposite ends of said table construction and a second pair of table top sections being disposed at opposite sides of said table construction.

10. The table construction of claim 9 wherein said one pair of table top sections are generally triangular in plan shape and said second pair of table top sections are trapezoidal in plan shape.

* * * * *